US009167948B2

(12) United States Patent
Tucker

(10) Patent No.: US 9,167,948 B2
(45) Date of Patent: Oct. 27, 2015

(54) HAND WORN WASHING DEVICE

(76) Inventor: Robert Tucker, Torrance, CA (US)

( * ) Notice: Subject to any disclaimer, the term of this patent is extended or adjusted under 35 U.S.C. 154(b) by 476 days.

(21) Appl. No.: 12/753,432

(22) Filed: Apr. 2, 2010

(65) Prior Publication Data

US 2011/0240760 A1 Oct. 6, 2011

(51) Int. Cl.
*B05B 9/08* (2006.01)
*A47L 13/19* (2006.01)
*A47L 13/23* (2006.01)

(52) U.S. Cl.
CPC *A47L 13/23* (2013.01); *A47L 13/19* (2013.01)

(58) Field of Classification Search
CPC ..... B05B 9/08; A47L 13/23; A47L 13/19
USPC ..... 239/153, 154, 310, 318; 137/268
See application file for complete search history.

(56) References Cited

U.S. PATENT DOCUMENTS

| | | | | | |
|---|---|---|---|---|---|
| 832,656 | A | * | 10/1906 | Cook | 401/42 |
| 836,181 | A | | 11/1906 | Cray | |
| 1,154,349 | A | | 9/1915 | Tanaka | |
| 2,250,878 | A | | 7/1941 | Quaranti | |
| 2,281,484 | A | * | 4/1942 | Ellinger | 239/314 |
| 2,405,154 | A | | 9/1946 | Logan | |
| 2,538,850 | A | | 1/1951 | Simms | |
| 2,663,890 | A | * | 12/1953 | Sullins | 401/7 |
| 2,795,460 | A | * | 6/1957 | Bletcher et al. | 137/564.5 |
| 3,778,172 | A | | 12/1973 | Myren | |
| 4,696,593 | A | | 9/1987 | Bayless | |
| 2,775,256 | A | | 10/1988 | Roth | |
| 4,859,102 | A | * | 8/1989 | Chamieh | 401/17 |
| 5,169,251 | A | | 12/1992 | Davis | |
| 5,169,252 | A | * | 12/1992 | Chappell | 401/46 |
| 5,240,339 | A | | 8/1993 | DeForest et al. | |
| 5,388,700 | A | | 2/1995 | Per-Lee | |
| 5,673,455 | A | | 10/1997 | Per-Lee et al. | |
| 6,109,214 | A | | 8/2000 | Rampersad | |
| 6,508,602 | B1 | | 1/2003 | Gruenbacher et al. | |
| 7,001,095 | B1 | | 2/2006 | Chen | |
| 7,478,768 | B2 | * | 1/2009 | Yip | 239/529 |

* cited by examiner

*Primary Examiner* — Arthur O Hall
*Assistant Examiner* — Chee-Chong Lee
(74) *Attorney, Agent, or Firm* — Ben J. Yorks; Irell & Manella LLP

(57) ABSTRACT

A hand worn washing device. The device includes a housing that has a soap chamber and a mixing chamber. The housing includes a chamber opening that provides fluid communication between the soap and mixing chambers. The housing also has at least one outlet opening. The device has a nozzle that directs fluid onto the chamber opening and an attachment feature that allows the housing and the nozzle to be attached to a human hand. A portion of water provided by the nozzle flows through the chamber opening and into the soap chamber. A mixture of soap and water flows back out of the soap chamber and into the mixing chamber. The soap and water further mix in the mixing chamber and the mixed soap/water is then dispensed through the outlet opening.

16 Claims, 3 Drawing Sheets

HAND WORN WASHING DEVICE

BACKGROUND OF THE INVENTION

1. Field of the Invention

The subject matter disclosed generally relates to the field of hand worn washing devices.

2. Background Information

Items such as cars and dogs are typically washed by applying soap, and then adding water to scrub the item. It would be desirable to provide a hand worn device that can simultaneously apply soap and water to improve the efficiency of the process.

The prior art includes devices that include a chamber of soap. Water is passed by an opening in the soap chamber and soap is pulled out of the chamber under a venturi effect. There are other devices wherein water is allowed to flow into one end of the soap chamber and out another end of the chamber. These devices introduce both soap and water to the item that is to be washed. The soap is not mixed with the water as it is dispensed from the device. This requires the user to mix the soap and water on the item. It would be desirable to provide a hand worn device that mixes the soap and water before being dispensed from the device. It would be desirable to provide mixed soap and water with a device that does not include any moving mechanical parts or an electrical energy sources, such as a battery.

BRIEF SUMMARY OF THE INVENTION

A hand worn washing device. The device includes a housing that has a soap chamber and a mixing chamber. The housing has at least the outlet opening and a chamber opening that provides fluid communication between the soap and mixing chambers. The device has a nozzle that directs fluid onto the chamber opening and an attachment feature that allows the housing and the nozzle to be attached to a human hand.

DETAILED DESCRIPTION

Figure 1:
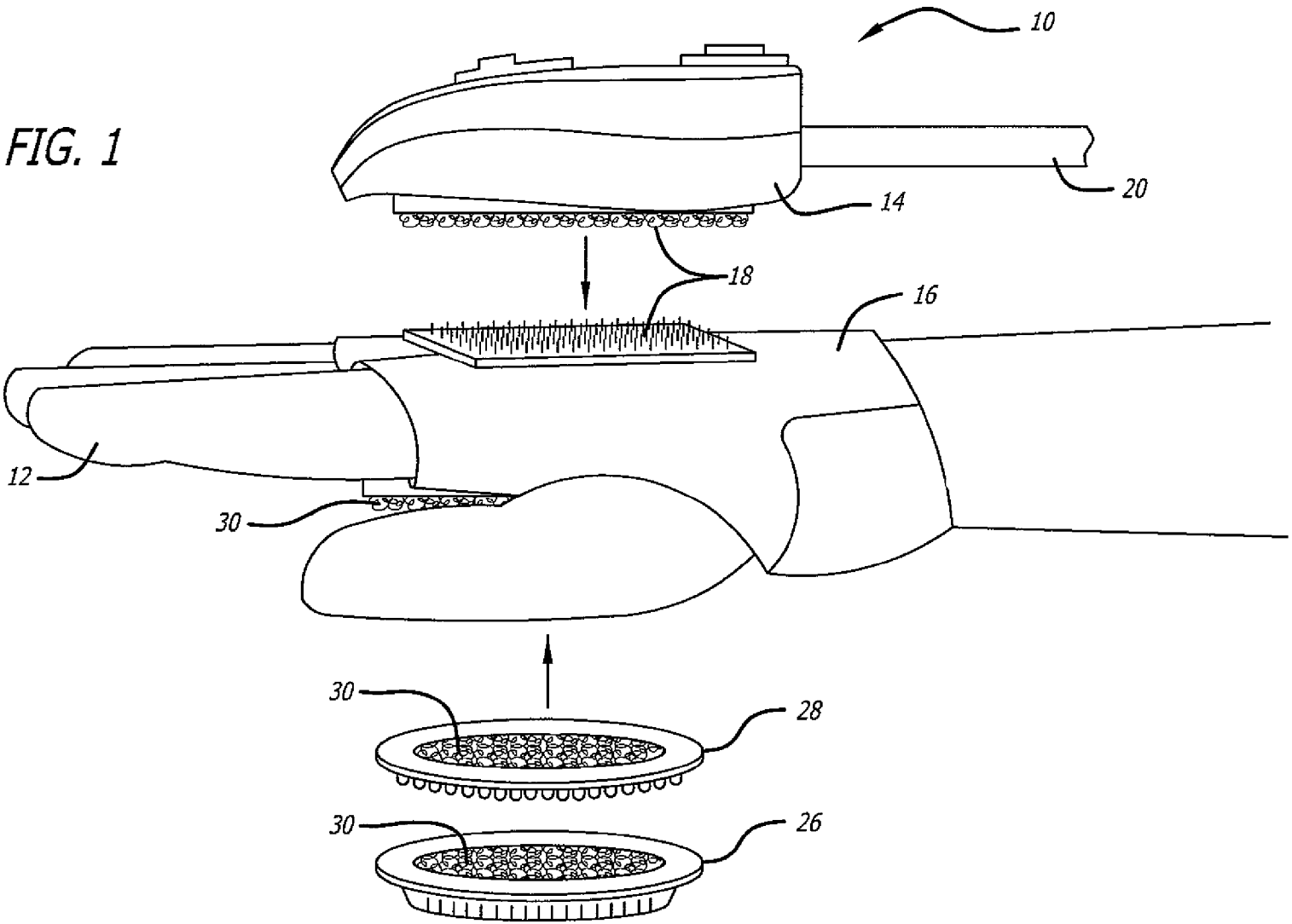
FIG. 1 is an illustration of a hand worn washing device.
Figure 2:
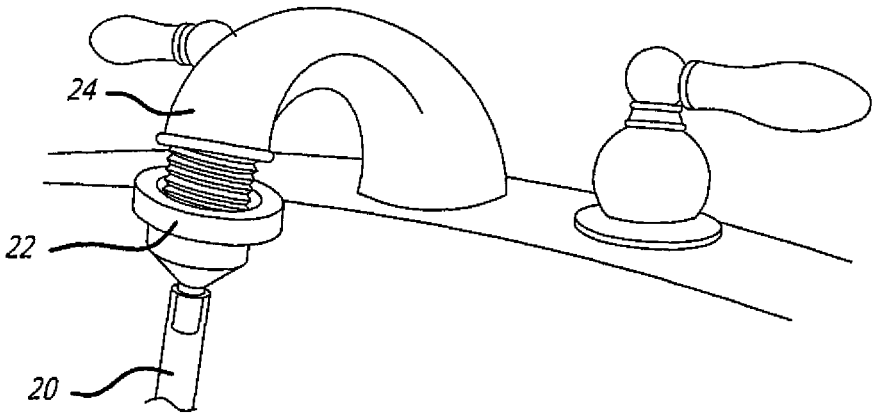
FIG. 2 is a perspective view showing a tube of the device being connected to a faucet.

Disclosed is a hand worn washing device. The device includes a housing that has a soap chamber and a mixing chamber. The housing includes a chamber opening that provides fluid communication between the soap and mixing chambers. The housing also has and at least one outlet opening. The device has a nozzle that directs fluid onto the chamber opening and an attachment feature that allows the housing and the nozzle to be attached to a human hand. A portion of water provided by the nozzle flows through the chamber opening and into the soap chamber. A mixture of soap and water flows back out of the soap chamber and into the mixing chamber. The soap and water further mix in the mixing chamber and the mixed soap/water is then dispensed through the outlet opening.

Referring to the drawings more particularly by reference numbers, FIGS. 1-4 show an embodiment of a hand worn device 10. The device 10 can be worn on a human hand 12 and used to dispense a mixture of soap and water. The device 10 includes a housing 14 that can be attached to a glove 16 by hook and loop material 18. Although hook and loop material is shown and described, it is to be understood that the housing may be attached to the glove and/or hand by other structures, such as a strap.

A tube 20 may extend from the housing 14. The tube 20 may have a connector 22 that can be connected to a faucet 24. The tube 20 may be constructed from rubber or other flexible material and have a length sufficient to allow attachment to the faucet 24 and use of the device 10 on an object such as a dog or a car.

A brush attachment 26 and a hair removal attachment 28 may be attached to the glove 16 by hook and loop material 30. Although hook and loop material 30 is shown and described, it is to be understood that other structures can be used to attach the attachments 26 and 28 to the glove 16 and/or the housing 14.

Figure 3:
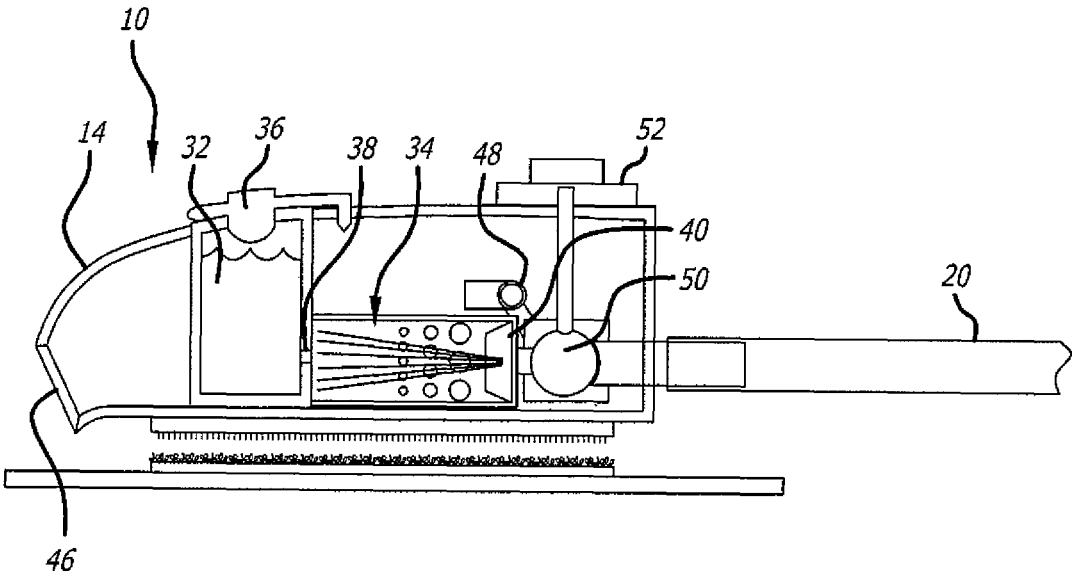
FIG. 3 is a side cross-sectional view of the device.
Figure 4:
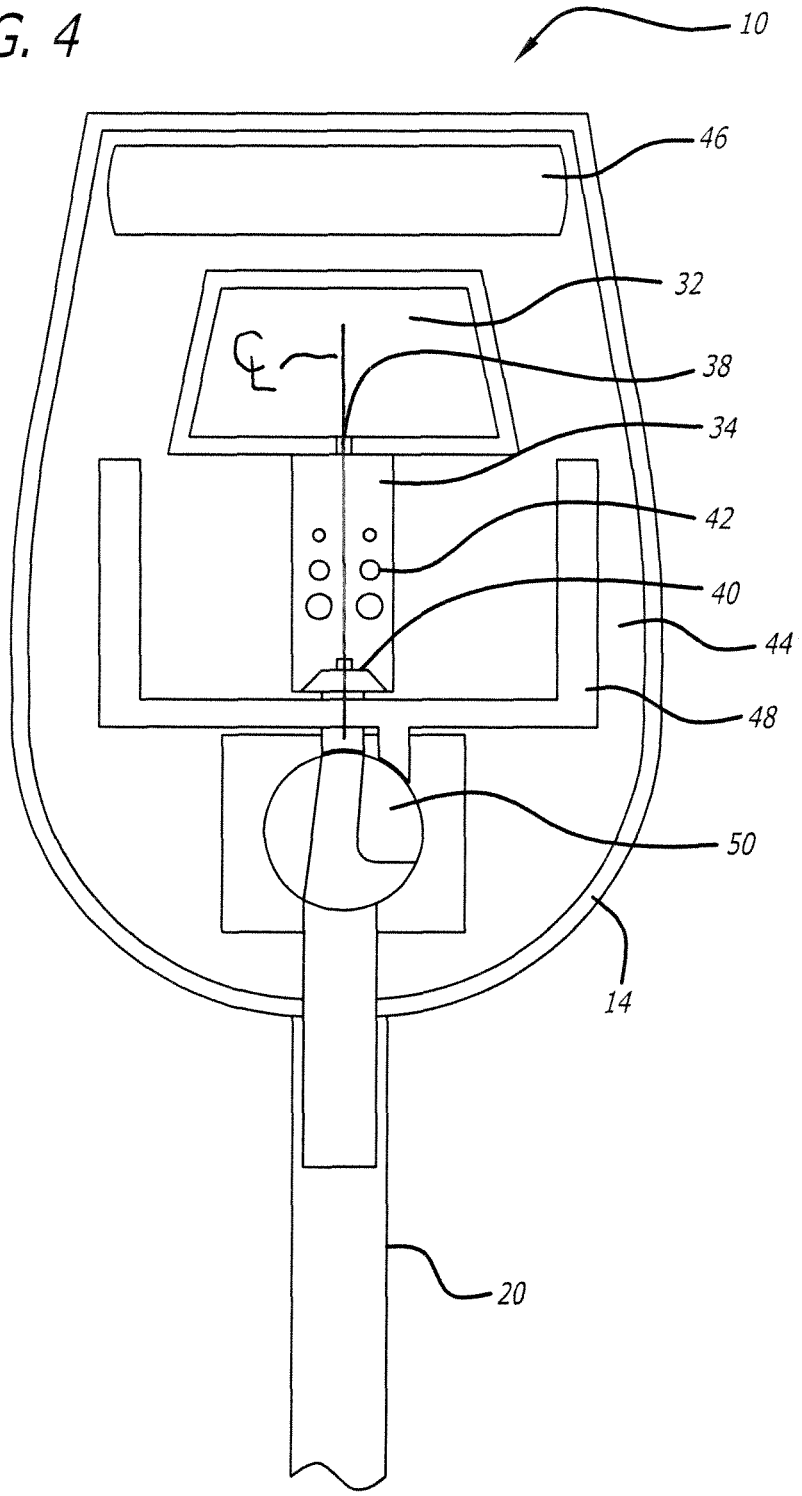
FIG. 4 is a top cross-sectional view of the device.

Referring specifically to FIGS. 3 and 4, the housing 14 includes a soap chamber 32 and a mixing chamber 34. The soap chamber 32 includes a fill plug 36 that can be pulled out to allow a user to fill the chamber 32 with soap. A chamber opening 38 provides fluid communication between the chambers 32 and 34.

A nozzle 40 is located within the mixing chamber 34 and can direct a stream of water onto the chamber opening 38. The nozzle 40 and opening 38 can be configured so that the stream of water is essentially perpendicular to the opening 38. The direct impingement of water forces a portion of the water through the opening 38 and into the soap chamber 32. The water mixes with a portion of the soap and then flows back through the opening 38 and into the mixing chamber 34. It is believed that water causes a portion of the soap to expand within the soap chamber 32. The expansion of soap increases the soap chamber pressure 32. The increase in soap chamber pressure pushes a portion of soap, and/or mixed soap and water, into the mixing chamber 34. The soap mixes with water within the mixing chamber 34.

The mixing chamber 34 includes openings 42 that allow the mixed soap and water to flow into an outer housing chamber 44. From the outer housing chamber 44 the mixed soap and water is dispensed from the device 10 through an outlet opening 46. The configuration of the nozzle impinging water directly onto the opening provides a mechanism for extracting soap from the chamber that actively mixes the soap and the water without requiring any mechanical moving parts.

The device 10 may further include a rinse tube 48. A three way valve 50 may be connected to the rinse tube 48 and the nozzle 40. The valve 50 may be connected to a dial located on an external surface of the housing 14. The dial 52 can be turned by a user into one of three states. There is an OFF state wherein the valve 50 prevents any water from flowing into the housing 14. There is a SUDS state wherein the valve 50 allows water to flow into the nozzle to create a mixture of soap and water (e.g., suds). Finally, there is a RINSE state in which the valve 50 directs water into the rinse tube 48. In the RINSE state soap is not mixed with the water. The water flows through outlet 46 and can be use to rinse an item.

To operate, a user can don the glove 16 and attach the housing 14. One of the attachments 26 or 28 may be attached to the glove 16. The dial 52 may be set in the OFF state and the tube 20 may be connected to a faucet 24. The faucet 24 is turned on and the dial 52 may be turned to the SUDS state. The user can place their hand over an object such as a dog or a car and wash the item. The device 10 dispenses mixed soap and water which can be applied by the user to the object. The attachments 26 or 28 can be applied to the object while dispensing the soap and water. After the wash cycle has been completed the user may turn the dial 52 to the RINSE state so that the device 10 dispenses water to rinse the object.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A hand worn washing device, comprising:

a housing that includes a soap chamber that contains a soap and a mixing chamber, said housing includes at least one outlet opening, and a chamber opening that provides fluid communication between said soap and mixing chambers;

a rinse tube coupled to said housing;

a nozzle that directs fluid by spraying onto said chamber opening so that at least a portion of the fluid impinges unto said chamber opening and into said soap chamber, said fluid mixes with said soap to increase a pressure of said soap chamber above a pressure of said mixing chamber so that a mixture of soap and fluid forces through said chamber opening into said mixing chamber: and a three way valve coupled to said nozzle and said rinse tube, said three way valve can be moved to a suds state to allow said mixture of soap and fluid to flow through said at least one outlet opening, to an off state to prevent fluid from flowing into said mixing chamber, or to a rinse state to allow fluid to flow through said rinse tube without allowing a flow of said mixture of soap and fluid to flow out of the mixing chamber.

2. The device of claim 1, further comprising a glove that is coupled to said housing.

3. The device of claim 2, wherein said housing is attached to said glove with hook and loop material.

4. The device of claim 2, further comprising a brush that is attached to said glove.

5. The device of claim 1, further comprising a rinse tube located within said housing and a valve that can direct flow to said nozzle or said rinse tube.

6. The device of claim 5, further comprising a dial that is located external to said housing and is coupled to said valve.

7. A hand worn wash and rinse device, comprising:

a housing that includes a soap chamber that contains a soap and a mixing chamber, said housing includes at least one outlet opening, and a chamber opening that provides fluid communication between said soap and mixing chambers;

a rinse tube coupled to said housing;

nozzle means for directing a spray of flow of fluid onto the chamber opening so that at least a portion of the fluid impinges unto the soap chamber through the chamber opening, said fluid mixes with said soap to increase a pressure of said soap chamber above a pressure of said mixing chamber so that a mixture of soap and fluid forces into the mixing chamber through the chamber opening, and the mixture of fluid and the soap is dispensed through said at least one outlet opening; and a three way valve coupled to said nozzle means and said rinse tube, said three way valve can be moved to a suds state to allow said mixture of soap and fluid to flow through said at least one outlet opening, to an off state to prevent fluid from flowing into said mixing chamber, or to a rinse state to allow fluid to flow through said rinse tube without allowing a flow of said mixture of soap and fluid to flow out of the mixing chamber.

8. The device of claim 7, further comprising a glove that is coupled to said housing.

9. The device of claim 8, wherein said housing is attached to said glove with hook and loop material.

10. The device of claim 8, further comprising a brush that is attached to said glove.

11. The device of claim 7, further comprising a rinse tube located within said housing and a valve that can direct flow to said nozzle means or said rinse tube.

12. The device of claim 11, further comprising a dial that is located external to said housing and is coupled to said valve.

13. A method for applying a mixed composition of soap and fluid, comprising:

providing a housing that includes a chamber opening that provides fluid communication between a soap chamber that contains a soap and a mixing chamber;

moving a three way valve to a suds state to direct a spray of flow of fluid onto the chamber opening so that at least a portion of the fluid impinges unto the soap chamber through the chamber opening and the fluid mixes with the soap to increase a pressure of the soap chamber above a pressure of a mixing chamber so that a mixture of soap and fluid forces into the mixing chamber through the chamber opening, dispensing the mixture of the fluid and the soap from the mixing chamber and out of the housing through at least one housing outlet opening;

moving the three way valve to an off state to prevent fluid from flowing into the mixing chamber; and moving the three way valve to a rinse state to allow the fluid to flow through a rinse tube without allowing flow of the mixture of soap and fluid to flow out of the mixing chamber.

14. The method of claim 13, further comprising turning a valve so that only water is dispensed from the housing outlet opening.

15. The method of claim 13, further comprising attaching a glove to the housing.

16. The method of claim 13, further comprising coupling the housing to a faucet.

* * * * *